US008500518B2

(12) United States Patent
Mueller

(10) Patent No.: US 8,500,518 B2
(45) Date of Patent: Aug. 6, 2013

(54) METHOD OF GRINDING AN INDEXABLE INSERT AND GRINDING WHEEL FOR CARRYING OUT THE GRINDING METHOD

(75) Inventor: Hubert Mueller, Nordrach (DE)

(73) Assignee: Erwin Junker Maschinenfabrik GmbH, Nordrach (DE)

( * ) Notice: Subject to any disclaimer, the term of this patent is extended or adjusted under 35 U.S.C. 154(b) by 852 days.

(21) Appl. No.: 12/309,899

(22) PCT Filed: Jul. 25, 2007

(86) PCT No.: PCT/EP2007/057687
§ 371 (c)(1),
(2), (4) Date: Feb. 2, 2009

(87) PCT Pub. No.: WO2008/015144
PCT Pub. Date: Feb. 7, 2008

(65) Prior Publication Data

US 2010/0062690 A1 Mar. 11, 2010

(30) Foreign Application Priority Data

Aug. 1, 2006 (DE) ..... 10 2006 035 845

(51) Int. Cl.
*B24B 1/00* (2006.01)

(52) U.S. Cl.
USPC ..... 451/57; 451/59

(58) Field of Classification Search
USPC ..... 451/49, 541, 543, 544, 57, 58, 62
See application file for complete search history.

(56) References Cited

U.S. PATENT DOCUMENTS

| | | | | |
|---|---|---|---|---|
| 3,537,216 | A | 11/1970 | Borgh | |
| 3,754,357 | A | 8/1973 | Schnellmann et al. | |
| 3,802,130 | A * | 4/1974 | Lindenbeck | 451/544 |
| 4,773,187 | A * | 9/1988 | Ohta et al. | 451/5 |
| 5,063,714 | A | 11/1991 | Meyer | |
| 6,893,324 | B1 * | 5/2005 | Laycock | 451/21 |
| 6,991,519 | B2 | 1/2006 | Laycock | |
| 2005/0079799 | A1 * | 4/2005 | Montandon et al. | 451/11 |
| 2005/0095961 | A1 | 5/2005 | Laycock | |

FOREIGN PATENT DOCUMENTS

| | | |
|---|---|---|
| DE | 88 04 567 | 5/1988 |
| DE | 88 04 584 | 5/1988 |
| DE | 38 11 584 | 10/1989 |
| DE | 42 40 053 | 6/1993 |
| DE | 43 01 214 | 8/1993 |

(Continued)

*Primary Examiner* — Dung Van Nguyen
(74) *Attorney, Agent, or Firm* — Jordan and Hamburg LLP

(57) ABSTRACT

In an indexable insert having wide sides, inclined narrow sides are to be ground, that is to say the grinding allowance 38 is to be removed. To this end, the indexable insert is set in rotation about a driven axis of rotation between a clamping insert and a thrust bolt. Serving for the grinding is a grinding wheel which rotates about rotation axis and which has a circumferential surface 18*a* contoured in a circular shape and having a largest diameter and is composed of a leading region and a trailing region. The grinding wheel is guided relative to the indexable insert along the geometrical defining line which is formed by the generating line of the finished narrow side in the feed direction. The leading region tapering forwards effects preliminary grinding of the narrow side by longitudinal grinding, whereas the trailing region effects finish grinding by linear contact with the narrow side. The grinding wheel is held with the clamping flanges on a grinding spindle. The grinding operation is effected with controlled movement of the driven axis of rotation, a first displacement axis, a second displacement axis and a pivoting movement of the grinding wheel relative to the indexable insert according to double arrow.

7 Claims, 11 Drawing Sheets

FOREIGN PATENT DOCUMENTS

| | | |
|---|---|---|
| DE | 295 14 702 | 11/1995 |
| JP | 50-27636 | 9/1975 |
| JP | 53-44991 | 12/1993 |
| JP | 7-156047 | 6/1995 |
| JP | 2006-15463 | 1/2006 |
| SU | 1342701 | 10/1987 |

* cited by examiner

METHOD OF GRINDING AN INDEXABLE INSERT AND GRINDING WHEEL FOR CARRYING OUT THE GRINDING METHOD

The invention relates to a method of grinding an indexable insert, wherein its narrow sides are moved along the circularly contoured circumferential surface of a rotating grinding surface and are ground thereby, having the following movements for the grinding process that are coordinated to one another using CNC control:

a) the indexable insert is caused to rotate about a rotational axis that runs perpendicular to its plane;

b) a grinding spindle that bears and drives the grinding wheel and the rotational axis of the indexable insert are displaced relative to one another in two displacement axes that run perpendicular to one another, the displacement axes and the rotational axis of the indexable insert being located in parallel planes or the same plane;

c) the grinding spindle and the indexable insert are pivoted relative to one another about a pivot axis that is perpendicular to the planes in which the displacement axes and the rotational axis of the indexable insert are located.

Such a grinding method is known from DE 42 40 053 A1. In this known method, the narrow sides of the indexable insert are ground with a narrow grinding wheel that has a cylindrical circumferential contour. The grinding wheel is driven by a grinding spindle that can be displaced in two horizontal planes that are perpendicular to one another. The indexable insert is disposed in a clamping device that can be pivoted about a vertical axis. The clamping device has two clamping flanges that clamp the indexable insert on its wide sides and cause it to rotate. A desired relief angle can be ground on the narrow sides of the indexable inserts due to the clamping device being pivoted about the vertical pivot axis. During the grinding process, the following four movements are continuously coordinated with one another using CNC control: the rotational movement of the indexable insert about its driven rotational axis (C axis), the movement of the grinding spindle in direction of the first displacement axis (Z axis) and the second displacement axis (X axis), and the pivoting movement of the clamping device about the vertical pivot axis (B axis). In this manner it is possible to grind flat narrow sides on the indexable insert with the desired relief angle.

Past conventional grinding processes, in which the narrow sides of the indexable insert are ground with pot-shaped grinding wheels, are intended to be improved using the known method in accordance with DE 42 40 053 A1. However, there were difficulties in accomplishing the grinding process with four movement axes controlled in an interpolating manner using CNC. Therefore in the known method in accordance with DE 42 40 053 A1 it is also expressly required that during grinding of the narrow sides the cylindrically contoured narrow grinding wheel is moved back and forth, oscillating, in the axial direction overlapping the controlled direction, which is intended to continuously correct the contact of the individual grinding grains on the grinding wheel. Nevertheless, in practice it has been demonstrated that the grinding results did not lead to the anticipated improvement. The results of the grinding, that is the quality of the ground narrow sides, demonstrated that the grinding wheel wear was too high and that there was unsatisfactory precision.

Presumably therefore, even after the publication of the suggestion according to DE 42 40 053 A1, additional suggestions for improving grinding with pot-shaped inserts were provided, such as e.g. DE 43 01 214 A1. Although the grinding result may have been improved, the pot-shaped grinding wheels provided to this end were particularly complicated, specifically they were constructed in multiple parts. Since frequently bevels must also be ground when grinding indexable inserts, at least two cylindrical abrasive layers that were in different planes were necessary. The narrow sides of the indexable insert were ground with the one abrasive layer that was placed lower, while the required bevels were to be ground with the second abrasive layer disposed in a different axial plane. Grinding with pot-shaped grinding wheels also involved difficulties in terms of mutual accessibility of the surfaces to be ground on the indexable insert. Therefore the improved method was also not economically satisfactory when grinding indexable inserts with pot-shaped grinding wheels.

Known in a simple device for finish grinding worn indexable inserts in accordance with DE 295 14 702 U1 is finish grinding the indexable inserts using a grinding wheel that has the sectional profile of a double cone. The device is for grinding indexable inserts whose wide sides have a rhombic contour. The indexable inserts are fastened to a tool carrier. Grinding wheel and tool carrier can be moved relative to one another in two horizontal directions and vertically. By raising and lowering the grinding wheels, a hollow grind can be formed on the indexable insert or a relief angle can be formed. The reason the contour of the grinding wheel is in the shape of a double cone is so that different narrow sides of the indexable insert are ground successively on the one or other tapered surface of the grinding wheel. For this, the clamped indexable insert must merely be pivoted on the tool carrier, there being at least one linear contact. This type of grinding is not comparable to a grinding method that is to be performed economically during mass production of indexable inserts.

SUMMARY OF THE INVENTION

The underlying object of the invention is therefore to create a grinding method of the type initially cited in the foregoing, with which method indexable inserts can be mass produced economically and in which indexable inserts the narrow sides are high quality, even when using sintered materials that are difficult to cut, and the desired dimensional, shape, and positional tolerances are maintained.

A first solution for this object according to the present invention is use of a grinding wheel that has a forward-tapering leading area and a cylindrical trailing area annexee thereto. The grinding method is conducted such that the leading area, which forms a lead angle relative to the contour of the indexable insert, performs longitudinal grinding using the principle of peel grinding and thus is the first to pass over the narrow side of the indexable insert. The leading area accomplishes rough grinding, for instance rough cutting. The majority of the grinding allowance is removed by the leading area. Because the leading area, at the site of its largest diameter, transitions to the cylindrical trailing area, there is a direct transition from rough grinding to finish grinding on the surface of the narrow sides. The two processes can thus occur simultaneously.

It has been demonstrated that in the inventive procedure very good grinding results are obtained in conjunction with significantly improved service life for the grinding wheels, i.e. the wear on the grinding wheels is significantly reduced. This can be attributed to the fact that during peel grinding cooling conditions are substantially improved with a grinding wheel that tapers forward in the longitudinal direction of the grinding process so that the grinding wheel is protected and a minimum amount of heat is introduced into the workpiece in the grinding zone. The connected trailing area is clearly shorter than the leading area; it can be e.g. only one-third of the grinding wheel thickness. When grinding by means of the trailing area, there is linear contact between the grinding wheel and the narrow side of the indexable insert because the grinding wheel is disposed perpendicular to the narrow side of the indexable insert. However, at this point only relatively little material is removed and the contact length is short. Thus here as well the heat stress on the grinding wheel and the workpiece is limited. The clearly reduced thermal stress on the grinding wheel has proved to be critical when grinding hard sintered materials that are difficult to cut. It was possible to clearly increase the service life of the grinding wheel in this manner. In addition, blanking dies made of ceramic materials can be machined using the grinding method.

In a second solution to the underlying object of the invention, the applicant has determined that slightly pivoting the grinding wheel with respect to the indexable insert can lead to results that are as good as the orientation perpendicular to the contour of the narrow side when grinding in accordance with the first solution. When proceeding in accordance with this aspect of the invention, the grinding wheel forms a lead angle in the leading area and forms a relief angle in the trailing area with respect to the narrow side of the indexable insert that is to be ground. This also occurs when the trailing area of the grinding wheel is cylindrically contoured, as in the procedure in accordance with the first aspect of the invention. In this case, the grinding wheel only grinds with the tapering leading area up to the greatest grinding wheel diameter. As can be seen, lead angle and relief angle lead to a further improvement in cooling. The method in accordance with the second aspect of the invention can also be carried out using peel grinding. With particularly hard sintered materials the rough grinding and finish grinding may be performed with two different grinding wheels.

If the trailing area is also embodied tapering starting from the largest diameter of the grinding wheel, a larger lead angle and a larger clearance angle result without the grinding wheel having to be tilted or pivoted particularly sharply with respect to the indexable insert.

In a third solution for the object underlying the invention, applicant has determined that the trailing area may even be completely omitted and that the procedure corresponding to the second aspect of the invention may also be performed with a grinding wheel that has in its circumferential area a tapering contour, for instance a conical contour, and is guided with the small diameter in front over the narrow sides of the indexable insert. The advantage of this solution is also particularly based on the improved cooling that results on the surface of the grinding wheel and the indexable insert.

When the leading area is characterized herein as being forward-tapering, this indicates that the grinding wheel moves with respect to an indexable insert that is axially stationary. Fundamentally, however, only a relative movement between indexable insert and grinding wheel is necessary in the advancing direction of the longitudinal grinding so that the term "forward" is only a guideline for the nature of the grinding wheel.

Since indexable inserts having a relief angle have a larger and a smaller wide side, there is the question of the direction in which the grinding wheel should be moved relative to the indexable insert. Fundamentally, both directions of movement are possible, that is, a movement by the insert from the small wide side to the larger wide side and vice versa. However, it has been found that with hard sintered materials and higher grinding power, in accordance with a first design of the inventive method it is better to guide the grinding wheels from the larger wide side of the indexable inserts via its narrow sides to the smaller wide side. The reason for this is that when grinding from the larger wide side the endangered cutting edge does not chip as easily in the area having the large sectional dimension as when this cutting edge is reached by the grinding wheel from the narrow side. Grinding pressure and thermal load are thus lower when grinding this cutting edge.

In accordance with another aspect of the method, peel grinding can also occur in the procedure in accordance with the second or third aspects of the invention.

In accordance with another advantageous aspect, it is provided that the tapering of the leading area and/or of the trailing area ( ) the first and second aspects of the invention) or even the entire tapering contour of the rotating grinding wheel (the third aspect of the invention) is shaped as an envelope of a cone. The circumferential lines of the leading area, trailing area, or grinding wheel that can be seen in the longitudinal section are thus straight lines. In terms of production engineering, this is a particularly favorable embodiment when dressing the grinding wheel. However, it must be noted this is by no means mandatory for technical grinding reasons. The tapering may thus also be embodied curved, e.g. as a spherical surface or hollow fillet, this being largely a function of the particular method being used for hard materials to be ground.

In many cases, in particular in the procedure in accordance with the first aspect of the invention, it is enough to undertake the entire graduation of the grinding, that is from rough cutting to finish grinding, using the leading area and trailing area of the grinding wheel. With the conical grinding wheel in accordance with the third aspect of the invention finish machining can also be accomplished in one pass using longitudinal and peel grinding. However, in the case of particularly hard sintered materials and particularly high grinding stress, it can also be necessary to divide the grinding process between two grinding wheels. This is the subject-matter of another advantageous aspect of the inventive method, successive grinding processes having different grinding wheel specifications but the same fundamental structure being used for rough cutting and finish cutting. The grinding machines necessary for this, for instance having pivotable grinding headstocks that bear two grinding spindles, belong to the prior art.

Despite the leading area and trailing area (the first and second aspects of the invention), the grinding wheels necessary for performing the inventive method have a relatively simple structure. Since the fundamentally disk-like basic shape of the grinding wheel is retained, mutual accessibility of the indexable insert having the circularly contoured circumferential surface, but also having the lateral surfaces of the grinding wheel, does not present any difficulties. In accordance with another advantageous aspect of the inventive method it is therefore possible with nothing further to grind the bevels of the indexable insert, which are located between the narrow sides and the wide sides, in the same clamping using the lateral surfaces of the rotating grinding wheel. Thus, in one and the same clamping, the narrow sides of the indexable insert and the bevels that are arranged between the individual flat narrow sides or between the narrow sides and the wide sides of the indexable insert can be ground with one and the same grinding wheel.

Finally, there is a particularly simple and thus advantageous option for performing the inventive method when the indexable inserts do not have to have a relief angle. The narrow sides of the indexable inserts then run perpendicular to their wide sides, and the relative pivotability of grinding wheel and indexable insert about a special pivot axis can be omitted.

The invention also relates to a special grinding wheel for performing the grinding method in accordance with various aspects of the invention. Corresponding to the different grinding processes that are to be performed using the leading area and the trailing area of the grinding wheel, the cutting material disposed on the circularly contoured circumferential surface of the grinding wheel always comprises diamond grains having a ceramic or metallic bond; however, the specifications for the grinding wheel differ in the leading area and in the trailing area. In the leading area, the cutting material and its bond can apply in particular to the requirements for rough cutting and in the trailing area they can apply to finish cutting, that is e.g. they can be finer.

One refinement of the inventive grinding wheel is comprised in that, for grinding the bevels, provided on the lateral surfaces of the grinding wheel as well is an abrasive layer that can then have grinding wheel specifications that differ from those in the circularly contoured circumferential surface of the grinding wheel.

As has already been noted regarding the method, in accordance with another aspect of the invention the inventive grinding wheel can have the tapering of the leading area and/or of the trailing area in the shape of an envelope of a cone without a determination being necessary for technical grinding reasons.

The invention shall now be explained in greater detail using exemplary embodiments depicted in drawings. The figures depict the following:

BRIEF DESCRIPTION OF THE DRAWINGS

FIG. 1 provides a schematic depiction of a view from above of a grinding machine that corresponds to a normal universal circular and non-circular grinding machine. Only the essential parts are depicted. A grinding table 2 on a machine bed 1 can be moved in the direction of a first displacement axis 3. The displacement axis 3 is identified as the Z axis, as is normal for grinding machines. The grinding table 2 bears a workpiece headstock 4 having a receiving unit 5 and a centering insert 6. The tailstock 7, having a centering receiving unit 8 and a thrust bolt 9, is arranged at a distance from the workpiece headstock 4. Workpiece headstock 4 and tailstock 7 can normally be moved towards one another, but also can normally be moved jointly. The indexable insert 10 to be ground can be affixed to, centered, and securely clamped on the centering insert 6 using the thrust bolt 9 of the tailstock 7.

Figure 1:
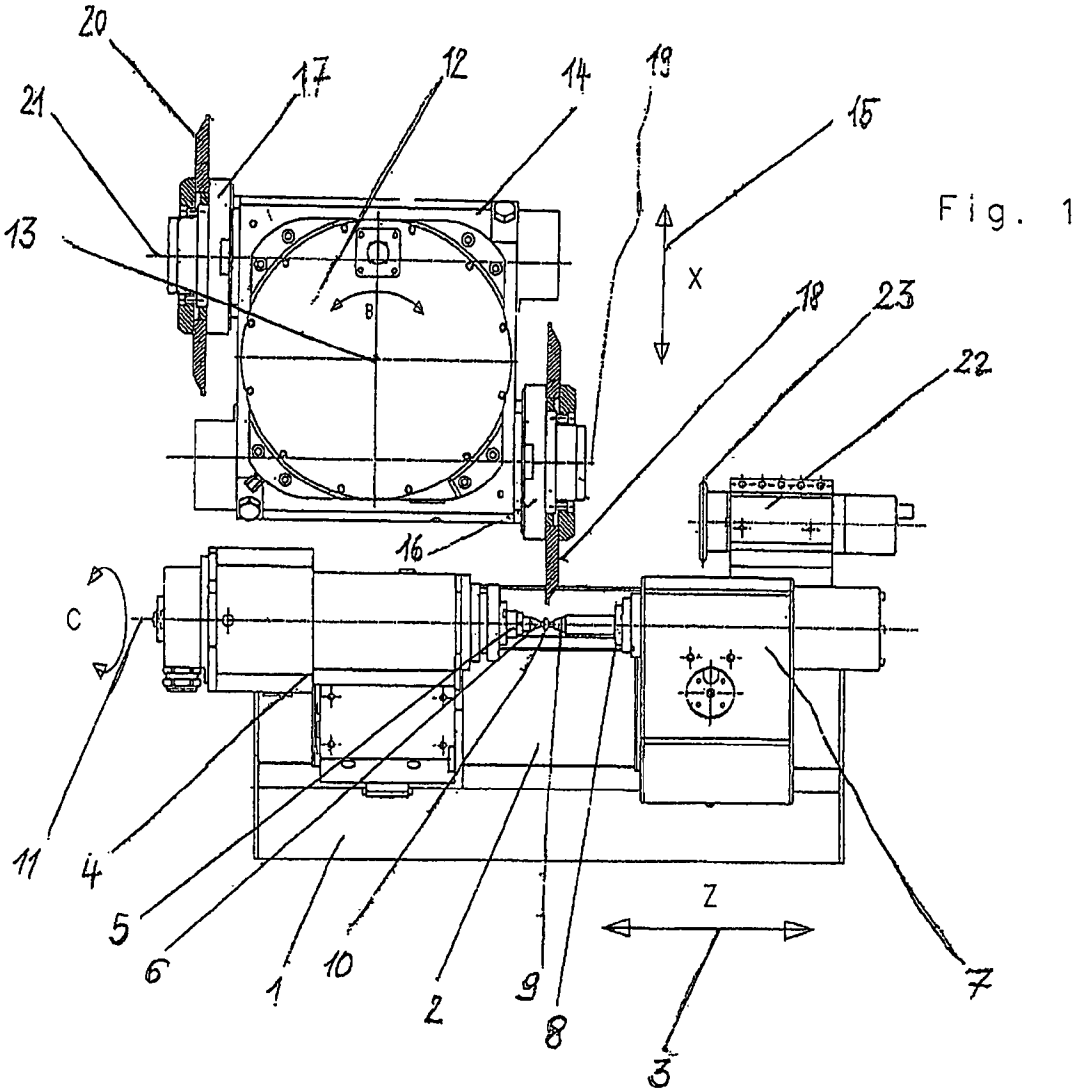
FIG. 1 depicts a view from above onto the essential parts of a grinding machine with which the inventive method is performed.

The indexable insert 10 can be rotationally driven using the workpiece headstock 4. Thus, during grinding the indexable insert 10 rotates about the driven rotational axis 11. The latter is generally called the C axis in grinding machines. Arranged at a distance from the grinding table 2 is a grinding headstock 12 that can be pivoted about a pivot axis 13 that runs perpendicular to the plane of the drawing. The pivot axis 13 is normally called the B axis. The grinding headstock 12 can be moved relative to the grinding table 2 in the direction of the second displacement axis 15 by means of a slide 14. The second displacement axis 15 is normally called the X axis in grinding machines.

The grinding headstock 12 bears a first grinding spindle 16 having a first grinding wheel 18 and a second grinding spindle 17 having a second grinding wheel 20. Each of the two grinding wheels 18, 20 has a circularly contoured circumferential surface 18*a*. The associated rotational axes of the first and second grinding spindles 16, 17 and grinding wheels 18, 20 are labeled 19 and 21.

A dressing spindle 22 having a dressing wheel 23 also belongs to the grinding machine and the two grinding wheels 18 and 20 can be positioned against it for dressing.

The ability of the grinding headstock 12 to pivot about the pivot axis 13 permits the first grinding wheel 18 and the second grinding wheel 20 to be pivoted selectively into grinding contact with the indexable insert 10 and also ensures that the required pivot movement of the grinding wheel during grinding is possible. In this case the pivot movement of the grinding headstock 12 about the pivot axis 13 is included in the CNC control for the entire grinding machine.

Thus, in the grinding machine for performing the inventive grinding method, four possible CNC-controlled movements are mutually coordinated with one another:

- Rotation of the indexable insert 10 about the driven axis 11 (C axis);
- Displacement of the indexable insert 10 via the grinding table 2 in the direction of the first displacement axis 3 (Z axis);
- Displacement of the grinding headstock 12 relative to the grinding table 2 in the direction of the second displacement axis 15 (X axis);
- Pivoting of the grinding headstock 12 about the pivot axis 13 (B axis).

The first and second displacement axes 3, 15 and the driven rotational axis 10 are located in parallel planes; they can even all be in the same plane. The pivot axis 13 is perpendicular to these planes or this plane.

What the CNC-controlled coordination of the four movement options attains, like a non-circular grinding machine, is that the narrow sides of the indexable insert 10 obtain the desired contour. In general flat surfaces having bevels in the transitions from the narrow sides to the two wide sides are sought.

Figure 2A:
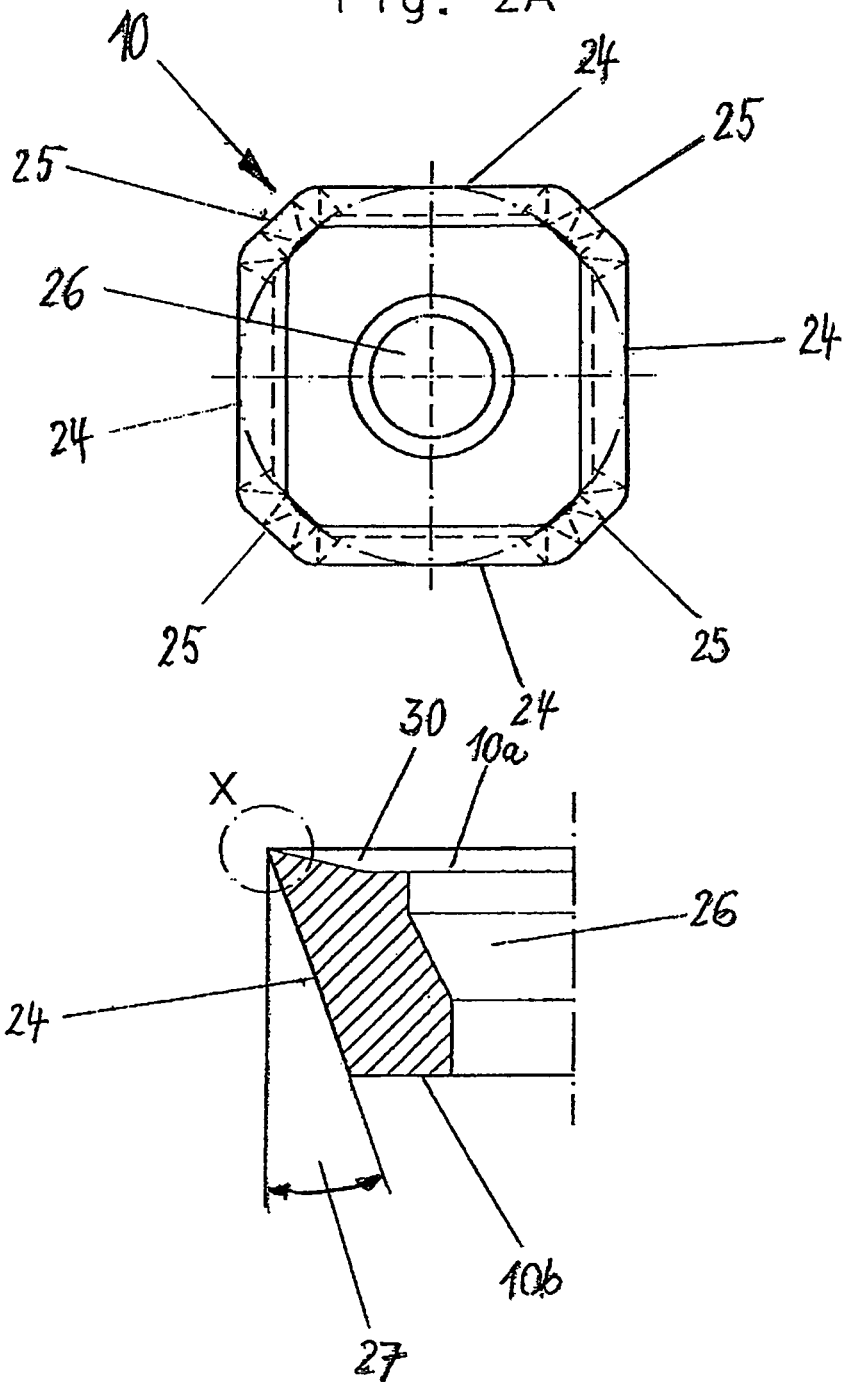
FIG. 2A is a side view and a partial sectional view of an indexable insert to be ground.
Figure 2B:
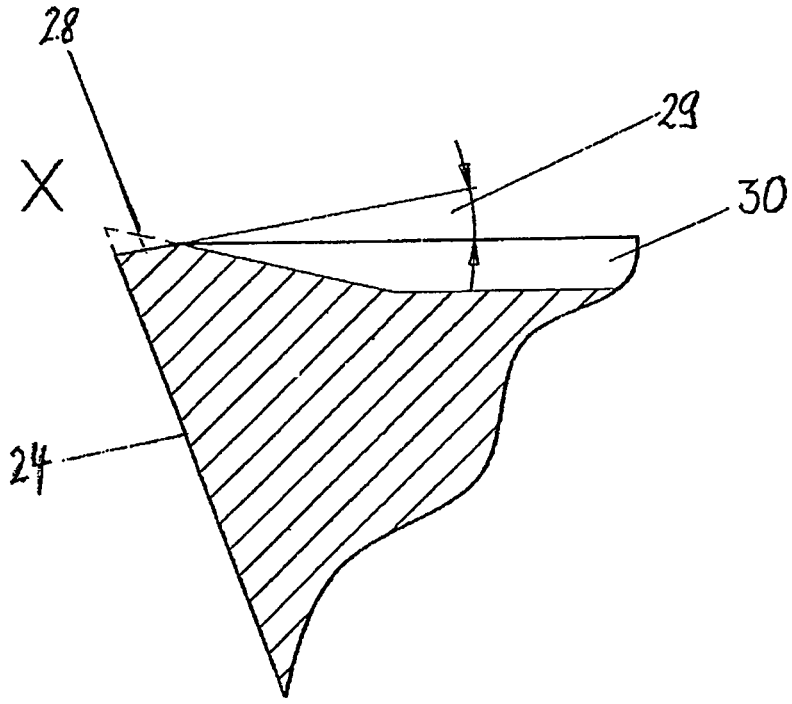
FIG. 2B provides a detail from the partial sectional view in accordance with FIG. 2A.

The indexable insert 10 to be ground is depicted in detail in FIGS. 2A and 2B. At the beginning of the grinding process its wide sides 10*a, b* are already finish-machined. Indexable inserts generally comprise sintered hard metal or ceramic materials; the wide sides 10*a*, 10 can be can be produced with satisfactory accuracy and fineness just by sintering. If higher accuracy is required, the wide sides are ground in a preceding work step. By means of a fastening bore 26 the indexable inserts can for instance be exchanged and rotated in workpiece retaining elements. In general they have a relief angle 27 so that their narrow sides 24 run at an incline to the wide sides. Therefore the one wide side 10*a* is larger than the other wide side 10*b*. The narrow sides 24 transition into one another via bevels 25. Bevels 28 can also be worked in the transition between the narrow sides 24 and the wide sides 10*a*, 10*b*, see FIG. 2B. In this case, a bevel angle 29 occurs in the edge area. Recesses 30 can be located in the wide sides 10*a*, 10*b* of the indexable inserts, or the wide sides 10*a*, 10*b* can be formed by the recesses 30. The clearance angle 27 can be omitted in certain applications so that the narrow sides 24 run perpendicular to the wide sides 10*a, b*. The individual angles depend on the purpose for which the indexable insert 10 will be used, especially the cutting task and the material to be machined that is to be cut with the indexable insert 10.

Figure 3:
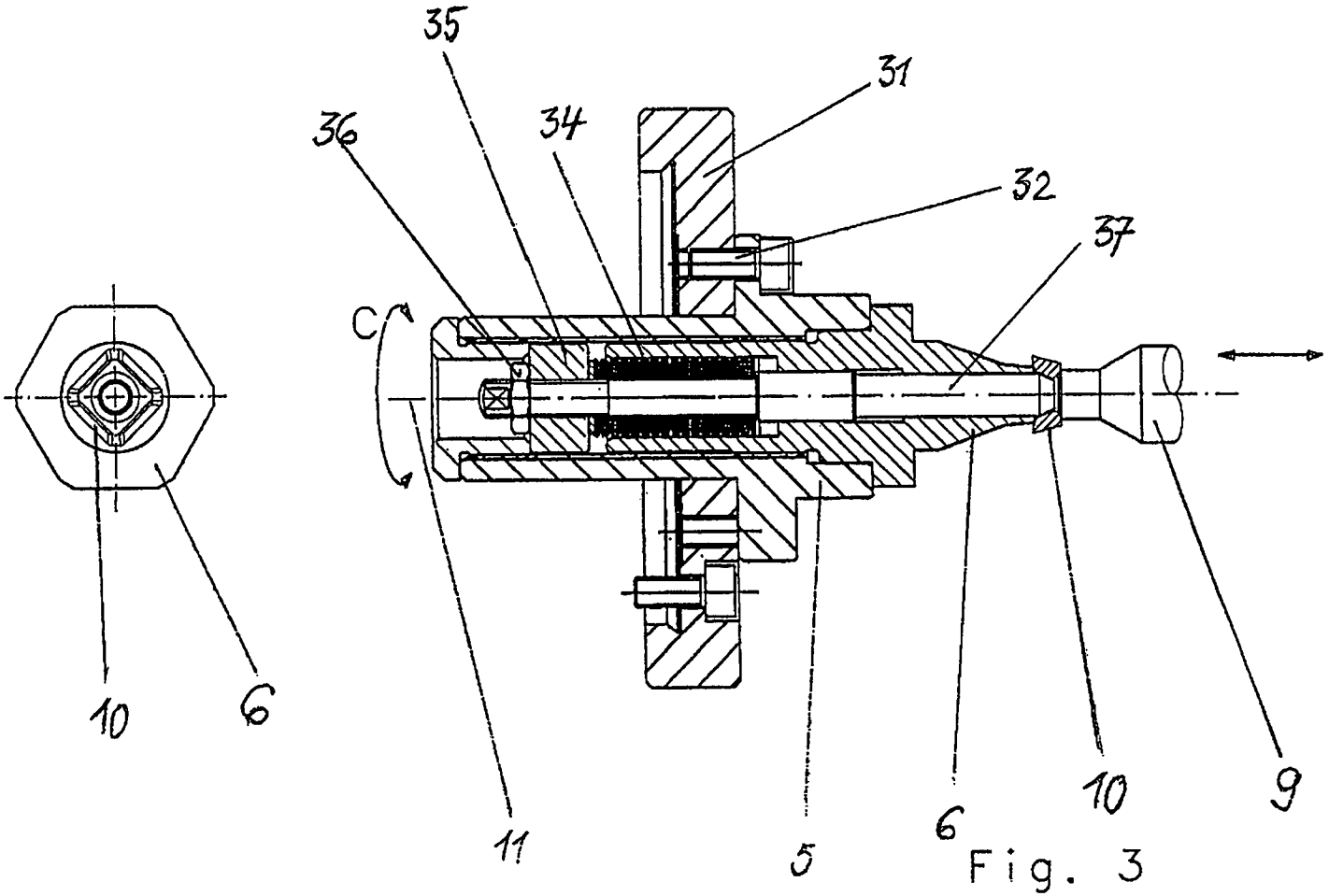
FIG. 3 depicts a longitudinal section and an end view in the area of the workpiece receiving unit for the workpiece headstock for the grinding machine in accordance with FIG. 1.

FIG. 3 provides an enlarged depiction of the details of the workpiece headstock. The aforesaid receiving unit 5 is fastened to the receiving part 31 for the workpiece headstock 4 using screws 32. The receiving unit 5 includes the clamping insert 6, which is provided with graduated bores in its longitudinal direction. Longitudinally movable therein is a centering bolt 37 that is pre-stressed towards the tailstock 7 by a compression spring 34. The inner end of the compression spring 34 is supported against a pressure plate 35. The pressure plate 35 simultaneously retains the centering bolt 37 with a nut 36. Rotating about the driven rotational axis 11 causes the clamping insert 6 to rotate. The indexable insert 10 is placed on the centering bolt 37 and is also supported on the shoulder of the clamping insert 6. Since the workpiece headstock 4 and tailstock 7 can be positioned relative to one another, the indexable insert 10 is clamped securely between the clamping insert 6 and the thrust bolt 9 of the tailstock 7 and caused to rotate in a non-positive fit. The structure depicted also enables rapid exchange, suitable for mass production, of the indexable inserts to be ground. Parts handling for loading into and unloading from the device is preferably completely automatic.

Figure 4:
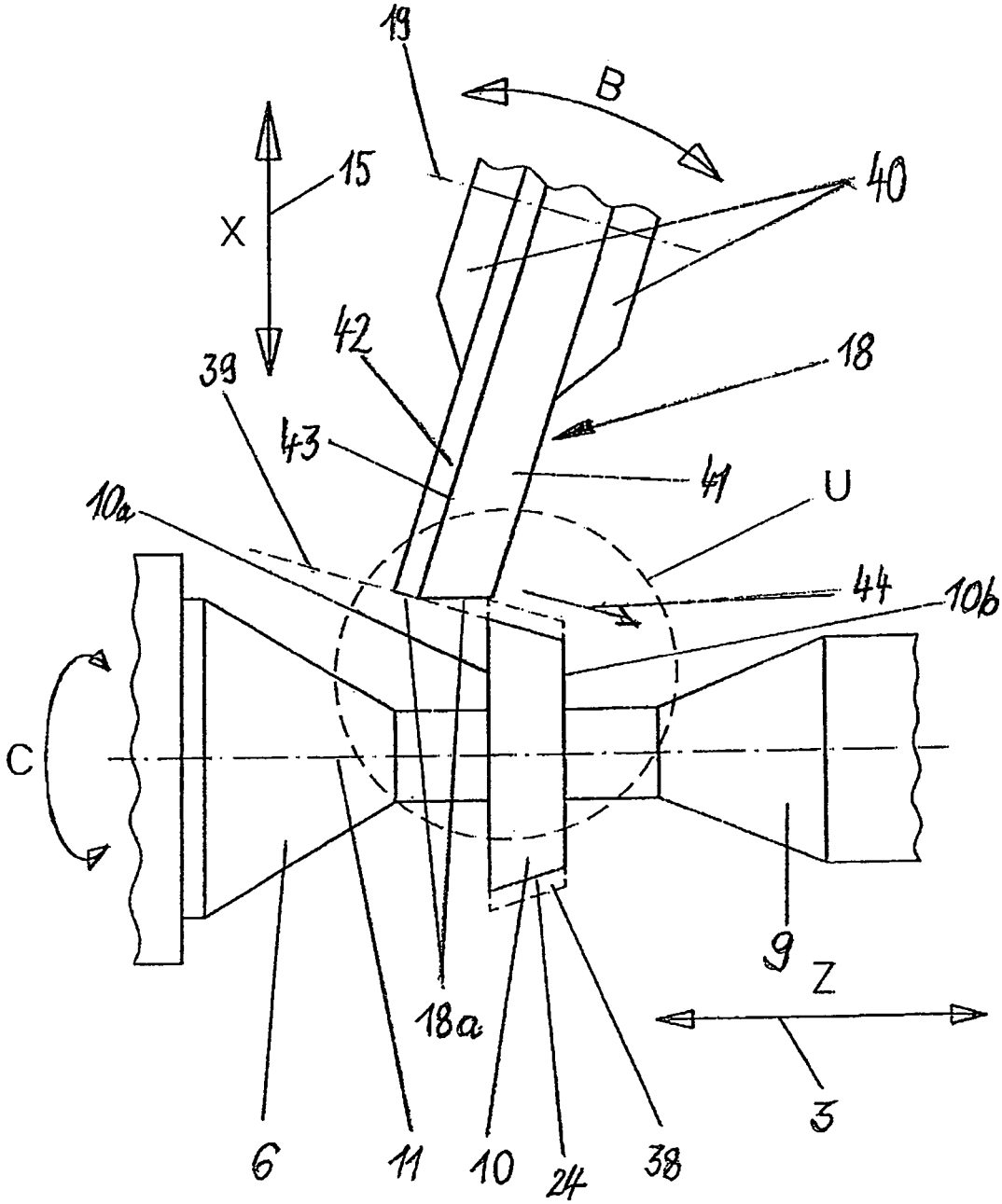
FIG. 4 depicts the principles for the applicable influencing variables when grinding the narrow sides of an indexable insert.

FIG. 4 provides a schematic depiction of the grinding process and its fundamental determining variables. The indexable insert 10, which is provided with a grinding allowance 38, is driven to rotate about the driven rotational axis 11. The extended surface of one narrow side 24 forms the geometric determining line 39 for the grinding process for this narrow side.

The grinding wheel 18 rotates about its rotational axis 19, the actual grinding body being clamped as usual between two clamping flanges 40. The rotating circumferential surface 18*a* of the grinding wheel 18 is circularly contoured, i.e., there is a circular contour in each radial plane of the grinding wheel. However, in its active grinding area the grinding wheel 18 constitutes a leading area 41 and a trailing area 42. The leading area 41 is embodied tapering in the axial direction. The grinding wheel 18 decreases from a greatest diameter 43 to a smaller diameter for its front lateral surface. The front lateral surface is defined by the advancing direction 44 in which the relative movement of the grinding wheel 18 takes place relative to the indexable insert 10 along the geometric determination lines 39. The indexable insert 10 can be moved and the grinding wheel can be stationary in the axial direction or vice versa.

In FIG. 4, the contour of the leading area 41 is depicted as a conical contour. The surface line of the leading area 41 that can be seen is thus a straight line. However, this is by no means mandatory; the surface line can also be curved, e.g. convex or shaped as a concave fillet, depending on the technological requirements of the cutting process. However, these shapes can also be freely determined depending on the shape of the workpiece and the grinding task. FIG. 4 also depicts that the mutual movement between the grinding wheel 18 and the indexable insert 10 in the advancing direction 44 begins with the larger wide side 10*a* and ends with the smaller wide side 10*b*. This is the generally preferred grinding direction because it reduces the risk that the circumferential edge of the indexable insert 10, which is disposed between the wide side 10*a* and the narrow side 24, will chip during grinding. However, it is also fundamentally possible to work with a different grinding direction so that the mutual movement begins with the smaller wide side 10*b*.

Annexed to the leading area 41 is a trailing area 42 that in this instance is cylindrically contoured so that the diameter of the trailing area is also the largest diameter of the leading area. The two areas transition into one another in the area of the largest diameter 43.

The grinding method is controlled in that, for rough grinding, peel grinding occurs in the leading area 41 and finish grinding occurs in the trailing area 42. As is known, with peel grinding the grinding wheel 48 is positioned such that the entire grinding allowance 38 is removed in a single longitudinal pass. Thus, while the peel grinding occurs using a tapering contour of the leading area, during finish grinding there is linear contact between the trailing area 42 and the narrow side 24 of the indexable insert 10.

Figure 5:
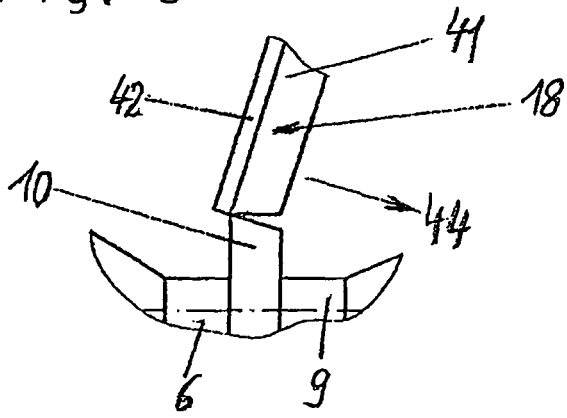
FIG. 5 depicts the grinding contact at the beginning of longitudinal grinding.
Figure 6:
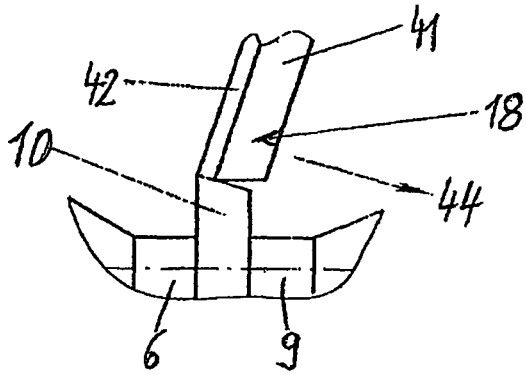
FIG. 6 depicts a phase of the grinding process that has progressed further.
Figure 7:
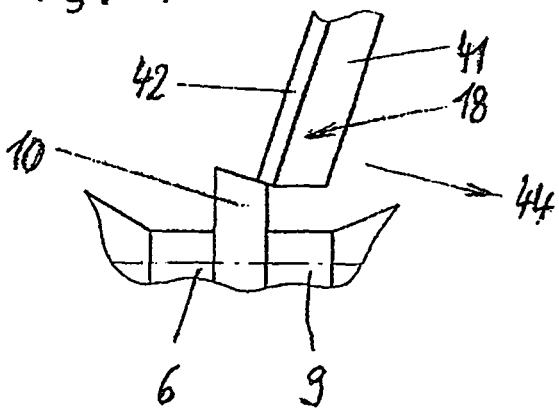
FIG. 7 depicts a grinding phase at the end of the finish grinding.

The grinding process occurs based on longitudinal grinding, the grinding wheel 18 being guided relative to the indexable insert 10, as is also illustrated in detail in FIGS. 1 through 7. FIGS. 5 through 7 depict the enlarged detail U from FIG. 4, but in more advanced phases of the grinding process.

The rough grinding and finish grinding can be performed as rough cutting and finish cutting. However, in certain applications, that is with sintered materials that are particularly difficult to cut, it can be useful to divide rough cutting and finish cutting between two different grinding wheels as the grinding machine in accordance with FIG. 1 makes possible in a known manner. In this case, the two grinding wheels 18 and 20 have the same fundamental structure but different grinding wheel specifications.

Even if the machining process is fundamentally based on longitudinal grinding, it must always be taken into consideration that the four different movements being continuously coordinated with one another with CNC control must be changed so that the desired result occurs.

FIGS. 4 through 7 together depict the progress of the longitudinal grinding with great clarity. In accordance with FIG. 4, the grinding wheel 18 is first positioned against the indexable insert 10 and contacts the grinding allowance 38 precisely with the leading area at the location of the larger wide side 10*a*. In the phase in FIG. 5, a majority of the grinding allowance has already been removed by the leading area 41 and the trailing area 42 is just about to be used.

In accordance with FIG. 6, there is complete linear contact between the trailing area 42 and the rough-ground narrow side 24. Although the rough grinding has not yet concluded, the finish grinding now begins with the entire axial extension of the trailing area 42. In FIG. 7 the finish grinding with the trailing area 42 has just ended and the grinding process has thus concluded. It should be noted that the bevels 25 between the individual narrow sides 24 are also ground during the course of the grinding process described herein.

Figure 8:
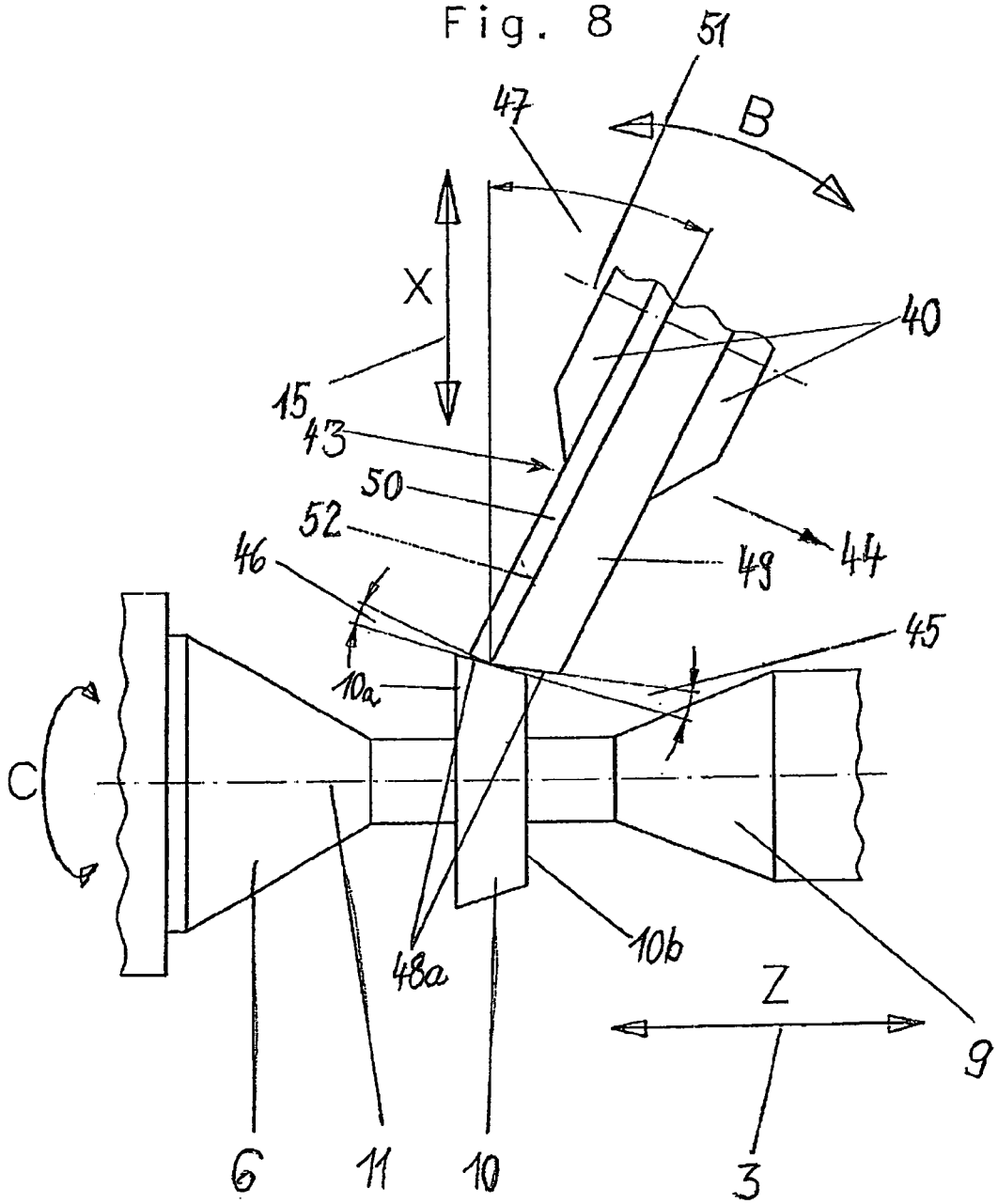
FIG. 8 illustrates a grinding method that has been modified relative to FIGS. 4 through 7, the rotating grinding wheel being slightly pivoted relative to the indexable insert.

FIG. 8 illustrates a grinding process that has been modified compared to the grinding process depicted in FIGS. 4 through 7.

The reference numbers for the depicted parts of the grinding machine and the indexable insert remain the same. However, a new series of reference numbers has been added for the rotating grinding wheel 48, because although the latter itself has not been changed, it has been moved to a different pivot position relative to the indexable insert 10. While in accordance with FIG. 4 the grinding wheel 18 is positioned perpendicular to the surface line of the narrow sides 24, in the depiction in accordance with FIG. 8 the grinding wheel 48 is pivoted forward about the tilt angle 47. This can easily be adjusted and maintained by means of the pivot axis 13. The grinding wheel 48 again has a forward-tapering leading area 49 and a cylindrical trailing area 50. Because of this, the circularly contoured circumferential surface 48*a* forms a lead angle 45 in the leading area 49 with respect to the resultant narrow side 24 of the indexable insert 10 and a clearance angle 46 in the trailing area 50. The clamping flanges for the rotating grinding wheel 48 are again labeled 40, their rotational axis 51, and their largest diameter 52.

The grinding wheel 48 is guided relative to the indexable insert 10 in the advancing direction 44 corresponding to longitudinal grinding on the narrow side 24 of the indexable insert 10. Peel grinding is preferred.

In the trailing area 50, it is no longer linear contact with the narrow side 24 of the indexable insert 10, but rather there is only point contact through the largest diameter 52. However, it has been demonstrated that even in this manner the desired contours can be reliably machined on the narrow sides 24 of the indexable insert 10. All of the machining can be done using peel grinding. If the grinding allowance 38 to be machined is greater, the contour can be ground in multiple steps; i.e., the grinding allowance is removed incrementally. The clearance angle 46 in the trailing area 50 leads to improved cooling because the linear contact between the indexable insert 10 and the trailing area 50 is eliminated.

Figure 9:
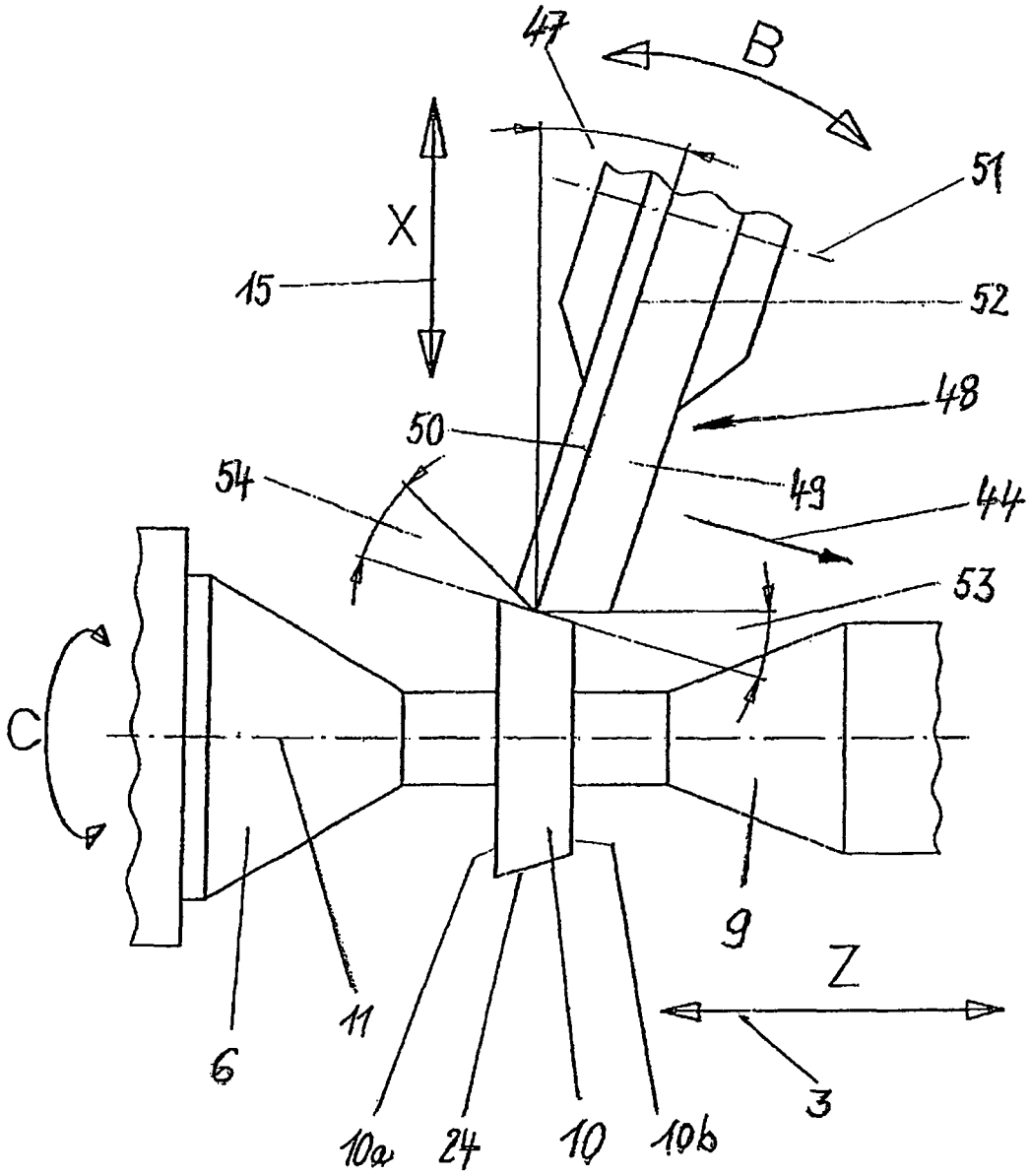
FIG. 9 is a depiction similar to FIG. 8, the rotating grinding wheel having a modified contour, however.

The subject-matter of FIG. 9 is a variant of the method sequence illustrated in FIG. 8. In this case, the contour of the trailing area 50 is not cylindrical, but rather tapers in opposition to the advancing direction 44 for longitudinal grinding, that is, it tapers toward the end of the grinding wheel 48. The contour of the tapering can preferably be conical, although other contours are also conceivable with nothing further. A larger lead angle 53 can be obtained in the leading area and a greater clearance angle 44 can be obtained in the trailing area 50 using the modified shape of the grinding wheel in accordance with FIG. 9 without the grinding wheel 48 having to be tilted more sharply relative to the lateral surface 24 of the indexable insert 10. Comparing the cutting angles 47 in FIGS. 8 and 9 illustrates this well. Longitudinal grinding can be performed with nothing further in the method in accordance with FIG. 9, as well.

Figure 10:
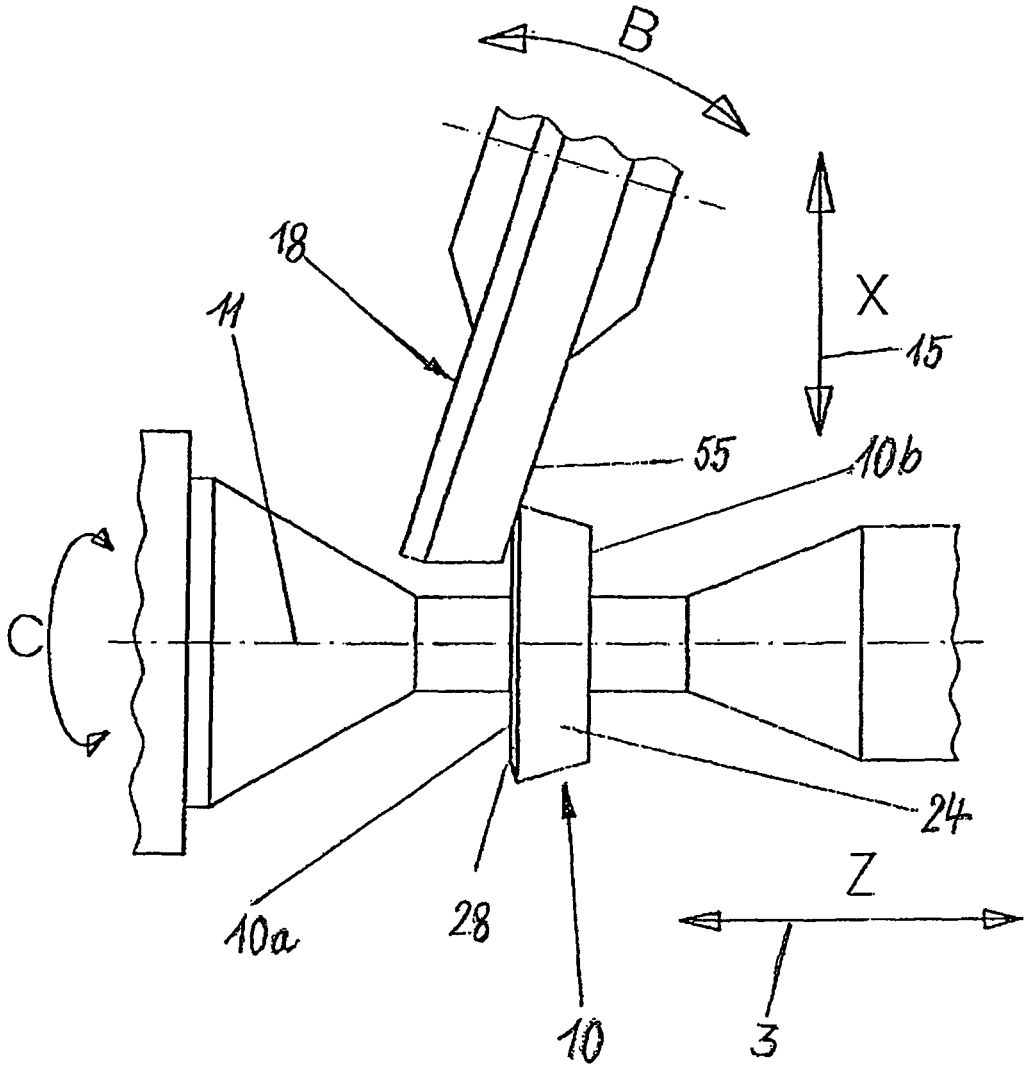
FIG. 10 clarifies how, with the inventive grinding method, even bevels can be ground on the indexable insert using the same grinding wheel and the same clamping.
Figure 11:
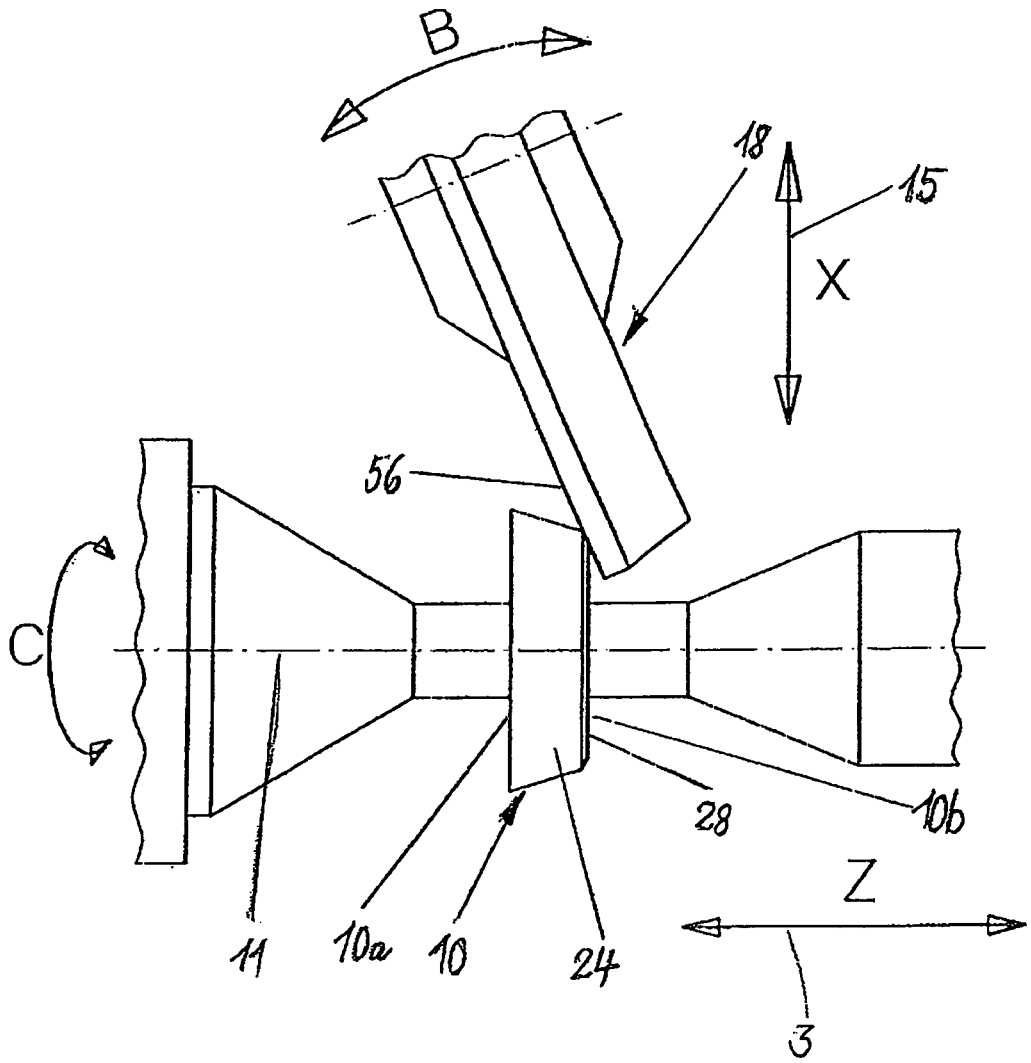
FIG. 11 corresponds to FIG. 10, the bevel being ground on the opposing side of the indexable insert.

Finally, FIGS. 10 and 11 depict how bevels 28 that are located in transition area between the wide sides 10*a, b* and the narrow sides 24 can be ground with the same grinding wheels 18 that grind the narrow sides 24. To this end, the wide sides 55, 56 of the grinding wheel 18 are also provided with an abrasive layer and are positioned laterally at an angle against the transition area between the wide sides 10*a, b* and the narrow sides 24 of the indexable insert 10.

Thus, for performing the aforesaid grinding method in accordance with the invention, grinding wheels are required that have two different areas axially, specifically a leading area 41, 49 and a trailing area 42, 50. While the leading area 41, 49 is embodied tapering towards the first lateral surface 55 of the grinding wheel 18, 48, the trailing area 42, 50 can be embodied cylindrical or also tapering toward the second lateral side 56. Since indexable inserts 10 comprise sintered hard metal or ceramic materials, the cutting material is formed by diamond grains with a ceramic or metal bond. As a rule, the grinding wheel specifications in the leading area 41, 49 will be different from those in the trailing area 42, 50, because as a rule the leading area 41, 49 works like a type of rough grinding, that is, must remove larger quantities of material then the trailing area 42, 50 and works more coarsely. The trailing area 42, 50 can be finer and softer in terms of its grinding specifications because the required surface characteristics must be attained primarily by the trailing area.

The abrasive layers on the lateral surfaces 55, 56 of the grinding wheels 18, 48 are also formed from ceramically or metallically bonded diamond grains and, corresponding to their purpose, which is to grind the bevels 28 on the indexable insert 10, themselves have different grinding wheel specifications than the leading area 41 or the trailing area 42, 50.

Figure 12:
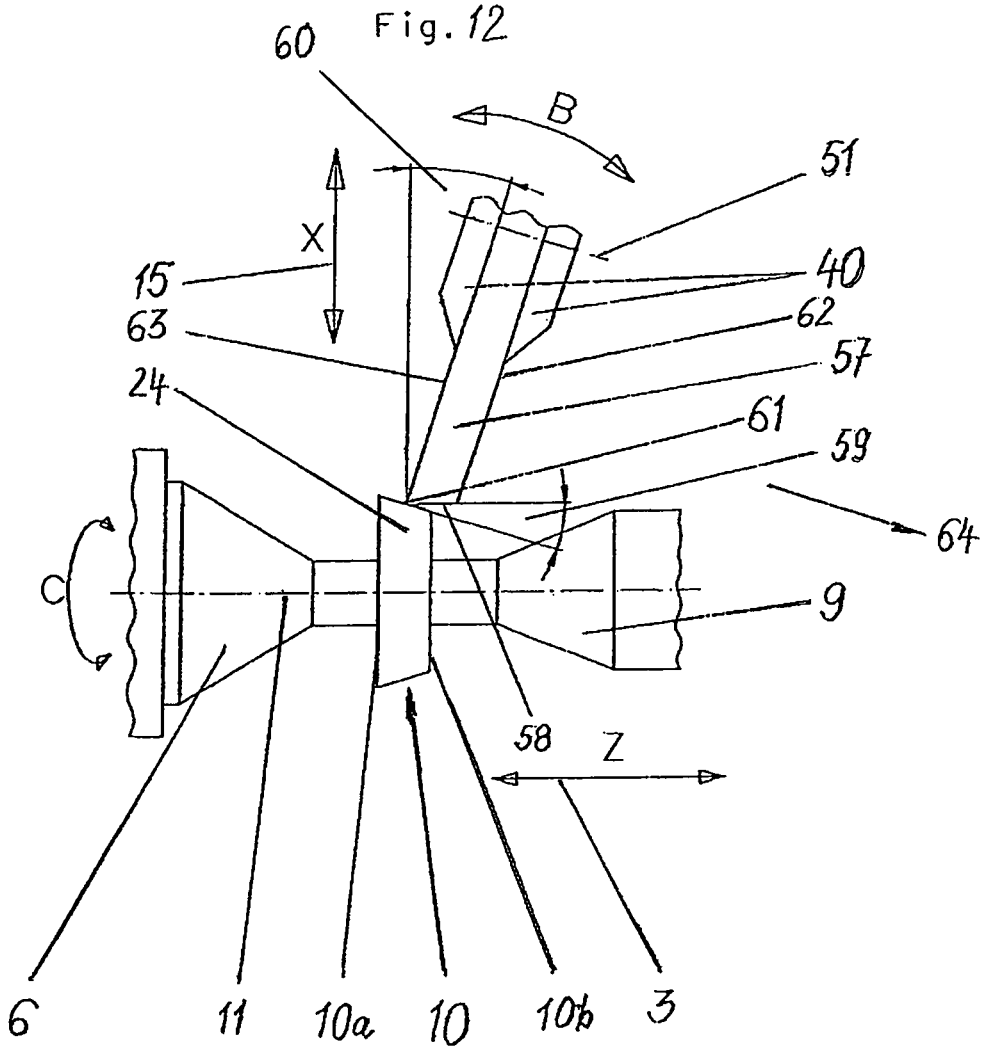
FIG. 12 explains another variant of the inventive method, the grinding wheel having a continuous tapering contour in its circumferential area.

In fact, it has been found that advantageous results can be obtained when the method is performed with a grinding wheel that does not have any trailing area. The grinding wheel then practically comprises only the leading area, that is, it has in its circumferential area a tapering contour, which in the simplest instance is a conical contour, and is guided, with its smallest diameter in front, across the narrow sides of the indexable inserts. FIG. 12 depicts this case.

FIG. 12 again depicts the indexable insert 10 with its wide sides 10*a, b* and its narrow sides 24. Here, as well, the reference numbers are the same, as are those for the workpiece receiving unit for the grinding machine and as are the four essential movement axes C, B, X, and Z. What is different from the previous depictions is that in this case the circularly contoured circumferential surface 58 of the grinding wheel 57 has a constant and continuously tapering contour, in the depicted exemplary embodiment it is that of the envelope of a cone with straight surface lines. The conical form is not mandatory, however. Indexable insert 10 and grinding wheel 57 are again tilted or pivoted towards one another about the tilt angle 60 and are guided relative to one another as for longitudinal grinding. The circumferential edge 61 formed on the larger lateral surface 63 of the grinding wheel 57 is in grinding contact with the indexable insert 10, and the smaller lateral surface 62 of the grinding wheel is oriented forward in the advancing direction 64 of the longitudinal grinding. As can be seen, a lead angle 59 is again formed between the circumferential surface 58 of the grinding wheel 57 and the narrow side 24 of the indexable insert 10.

The invention claimed is:

1. Method of grinding an indexable insert having narrow sides contiguous with first and second wide sides, comprising moving the narrow sides along a circularly contoured surface of a rotating grinding wheel whereby the narrow, sides are ground by the grinding wheel, wherein movements (a), (b) and (c) as follows are coordinated with respect to each other:

(a) the indexable insert is rotated about a rotational axis which is substantially perpendicular to a plane of symmetry of the indexable insert;

(b) a grinding spindle that carries and rotates the grinding wheel and the rotational axis of the indexable insert are displaced relative to each other in two displacement axes that are perpendicular to each other, the displacement axes and the rotational axis of the indexable insert being in parallel planes or the same plane; and (c) the grinding spindle and the indexable insert are pivoted relative to each other about a pivot axis that is perpendicular to the plane or planes in which the displacement axes and the rotational axis are located;

wherein the relative movement of the grinding wheel occurs along geometric determination lines at each of the pivoted positions of the grinding spindle carrying the grinding wheel and the indexable insert that are pivoted relative to each other about a pivot axis that is perpendicular to the plane or planes in which the displacement axes and the rotational axis are located until grinding thereof is complete, said geometric determination lines being continuous with and collinear with the surfaces of each of the narrow sides of the indexable insert and parallel to the advancing direction and rotational axis of the grinding wheel;

the grinding is longitudinal, wherein the circularly contoured circumferential surface of the rotating grinding wheel and the indexable insert are guided relative to each other so that the circularly contoured circumferential surface of the grinding wheel traverses the narrow sides of the indexable insert beginning at the first wide side to the second wide side; and during the longitudinal grinding a forward-tapering leading area of the grinding wheel that is angularly displaced from a surface of the indexable insert when in contact therewith rough grinds the narrow sides of the indexable insert and a cylindrically shaped trailing area of the grinding wheel, which is annexed to the leading area and is disposed behind the leading area during the longitudinal grinding, linearly contacts the narrow sides thereby to finish grind the narrow sides.

2. Method according to claim 1, wherein the rough grinding is peel grinding.

3. Method according to claim 1, wherein the first wide side is larger than the second wide side.

4. Method according to claim 1, wherein the taper of the forward-tapering leading area is frustoconical.

5. Method according to claim 1, further comprising grinding at least one bevel between the narrow sides and the wide sides of the indexable insert and conducting all grinding steps in a single clamping of the indexable insert.

6. Method according to claim 1, wherein the leading area tapers from a greatest diameter of the grinding wheel toward a first lateral face of the grinding wheel, the trailing area begins at the greatest diameter of the grinding wheel and extends cylindrically toward a second lateral face of the grinding wheel, each of the leading and trailing areas comprising an abrasive layer comprising ceramically or metallically bonded diamond grains, and the abrasive layer in each of the leading and trailing areas is different from the other.

7. Method of grinding an indexable insert having narrow sides contiguous with first and second wide sides, wherein no re-entrant angle is being ground, comprising moving the narrow sides along a circularly contoured surface of a rotating grinding wheel whereby the narrow sides are ground by the grinding wheel, wherein movements (a) and (b) as follows are coordinated with respect to each other:

(a) the indexable insert is rotated about a rotational axis which is substantially perpendicular to a plane of symmetry of the indexable insert; and (b) a grinding spindle that carries and rotates the grinding wheel and the rotational axis of the indexable insert are displaced relative to each other in two displacement axes that are perpendicular to each other, the displacement axes and the rotational axis of the indexable insert being in parallel planes or the same plane;

wherein the relative movement of the grinding wheel occurs along geometric determination lines throughout rotation of each of the grinding spindle that carries and rotates the grinding wheel and the indexable insert until grinding thereof is complete, said geometric determination lines being continuous with and collinear with the surfaces of each of the narrow sides of the indexable insert and parallel to the advancing direction and rotational axis of the grinding wheel;

the grinding is longitudinal, wherein the circularly contoured circumferential surface of the rotating grinding wheel and the indexable insert are guided relative to each other so that the circularly contoured circumferential surface of the grinding wheel traverses the narrow sides of the indexable insert beginning at the first wide side to the second wide side; and during the longitudinal grinding a forward-tapering leading area of the grinding wheel that is angularly displaced from a surface of the indexable insert when in contact therewith rough grinds the narrow sides of the indexable insert and a cylindrically shaped trailing area of the grinding wheel, which is annexed to the leading area and is disposed behind the leading area during the longitudinal grinding, linearly contacts the narrow sides thereby to finish grind the narrow sides.

* * * * *